US008531372B2

(12) United States Patent
Ben-David

(10) Patent No.: US 8,531,372 B2
(45) Date of Patent: Sep. 10, 2013

(54) METHOD, DEVICE AND SYSTEM OF RESPONSE TIME COMPENSATION UTILIZING AN OVERDRIVE SIGNAL

(75) Inventor: Ilan Ben-David, Rosh Ha'ayin (IL)

(73) Assignee: Samsung Display Co., Ltd. (KR)

( * ) Notice: Subject to any disclaimer, the term of this patent is extended or adjusted under 35 U.S.C. 154(b) by 1094 days.

(21) Appl. No.: 11/629,083

(22) PCT Filed: Jun. 14, 2005

(86) PCT No.: PCT/IL2005/000624
§ 371 (c)(1),
(2), (4) Date: Dec. 11, 2006

(87) PCT Pub. No.: WO2005/120169
PCT Pub. Date: Dec. 22, 2005

(65) Prior Publication Data

US 2008/0204393 A1 Aug. 28, 2008

Related U.S. Application Data

(60) Provisional application No. 60/578,854, filed on Jun. 14, 2004.

(51) Int. Cl.
*G09G 3/36* (2006.01)
*G09G 5/02* (2006.01)

(52) U.S. Cl.
USPC ..... 345/98; 345/87; 345/694

(58) Field of Classification Search
USPC ..... 345/55–56, 61, 63, 87–88, 98, 204, 345/613, 639, 690–696
See application file for complete search history.

(56) References Cited

U.S. PATENT DOCUMENTS

| | | | | |
|---|---|---|---|---|
| 5,387,947 | A * | 2/1995 | Shin | 348/699 |
| 5,512,956 | A * | 4/1996 | Yan | 348/606 |
| 5,646,691 | A * | 7/1997 | Yokoyama | 348/416.1 |
| 6,421,384 | B1 * | 7/2002 | Chung et al. | 375/240.09 |
| 7,295,173 | B2 * | 11/2007 | Itoh et al. | 345/63 |
| 7,356,082 | B1 * | 4/2008 | Kuhn | 375/240.16 |
| 7,382,349 | B1 * | 6/2008 | Kuhns | 345/102 |

(Continued)

FOREIGN PATENT DOCUMENTS

WO WO 02/101644 12/2002

OTHER PUBLICATIONS

International Search Report for International Application No. PCT/IL05/00624 mailed Feb. 4, 2008.

*Primary Examiner* — Bipin Shalwala
*Assistant Examiner* — Keith Crawley
(74) *Attorney, Agent, or Firm* — Innovation Counsel LLP

(57) ABSTRACT

Embodiments of the present invention provide an apparatus, system, and method of reproducing a sequence of at least first and second color image frames by controllably activating an array of liquid crystal elements, the array including at least a first liquid crystal element to reproduce first and second sub-pixel values in the first and second frames, respectively. Some demonstrative embodiments may include estimating the first sub-pixel value based on a third sub-pixel value to be reproduced in the second frame by a second liquid crystal element of the array which is shifted in relation to the first liquid crystal element by a location shift value associated with the first liquid crystal element; and generating an overdrive signal for activating the first liquid crystal element based on a combination of the first and second sub-pixel values. Other embodiments are described and claimed.

10 Claims, 5 Drawing Sheets

(56) References Cited

U.S. PATENT DOCUMENTS

2001/0055338 A1* 12/2001 Machida ..... 375/240.16
2003/0001871 A1* 1/2003 Morita ..... 345/690
2003/0038764 A1 2/2003 Oehlbeck et al.
2005/0146495 A1* 7/2005 MacKinnon et al. ..... 345/98
2005/0162566 A1* 7/2005 Chuang et al. ..... 348/714
2005/0184941 A1* 8/2005 Halfant ..... 345/87
2007/0063956 A1* 3/2007 Jong et al. ..... 345/98

* cited by examiner

METHOD, DEVICE AND SYSTEM OF RESPONSE TIME COMPENSATION UTILIZING AN OVERDRIVE SIGNAL

CROSS-REFERENCE TO RELATED APPLICATIONS

This application is a National Phase Application of PCT International Application No. PCT/IL2005/000624, entitled "Method, Device and System of Response Time Compensation", International Filing Date Jun. 14, 2005, published on Dec. 22, 2005 as International Publication No. WO 2005/120169, which in turn claims priority from U.S Provisional Patent Application No. 60/578,854, filed Jun. 14, 2004, both of which are incorporated herein by reference in their entirety.

FIELD OF THE INVENTION

The invention relates to color display systems generally and, more particularly, to flat screen display panels, for example, liquid crystal displays.

BACKGROUND

A Liquid Crystal Display (LCD) device may include an array of Liquid Crystal (LC) elements, which may be driven, for example, by Thin Film Transistor (TFT) elements. Each full-color pixel of a displayed image may be reproduced by three sub-pixels, each sub-pixel corresponding to a different primary color, e.g., each full pixel may be reproduced by driving a respective set of LC elements in the LC array, wherein each LC element is associated with a color sub-pixel filter element. For example, three-color sub-pixels may be reproduced by red (R), green (G) and blue (B) sub-pixel filter elements. Thus, each sub-pixel may have a corresponding cell in the LC array. The light transmission through each LC element may be controlled by controlling the orientation of molecules in the LC element. The time response of the LC element may be related to the time required for changing the orientation of the LC molecules.

The LCD may be implemented for displaying a sequence of image frames each including a momentary image, e.g., in accordance with a video input signal.

Unfortunately, the displayed image may appear "blurred" to a user, if the time response of the LC elements is significant in relation to the frequency at which the frames are displayed.

In order to reduce the "blurriness" of displayed images, the LCD device may implement a Response Time Compensation (RTC) method, e.g., a Feed Forward (FFD) method. The FFD method may include controlling the LC element based on a comparison between a sub-pixel value of a certain LC element in a previous frame and a sub-pixel value of the certain LC element in a current frame. For example, a Look Up Table (LUT) may be used to provide the LC element with a control signal based on the previous sub-pixel value and the current sub-pixel value.

The FFD method may require using a memory to store the sub-pixel values of the previous frame. The size of such memory may be relatively large, e.g., a memory of approximately 6 Megabytes (MB) may be required for storing the sub-pixel values of a three-primary, e.g., RGB, display having 1080 lines each including 1920 pixels. The size of the memory may be reduced, e.g., to approximately 600 Kilobytes (KB), by using suitable compression techniques.

SUMMARY OF SOME DEMONSTRATIVE EMBODIMENTS OF THE INVENTION

Some demonstrative embodiments of the invention include a method, device and/or system of reproducing a sequence of at least first and second color image frames by controllably activating an array of liquid crystal elements, the array including at least a first liquid crystal element to reproduce first and second sub-pixel values in the first and second frames, respectively.

Some demonstrative embodiments of the invention may include estimating the first sub-pixel value based on a third sub-pixel value to be reproduced in the second frame by a second liquid crystal element of the array which is shifted in relation to the first liquid crystal element by a location shift value associated with the first liquid crystal element; and generating an overdrive signal for activating the first liquid crystal element based on a combination of the first and second sub-pixel values.

In some demonstrative embodiments of the invention, the location shift value may represent a shift of a location of an image element reproduced by the first liquid crystal element in the first frame in relation to a location of the image element in the second frame.

One demonstrative embodiment of the invention may include detecting a first set of one or more edge sub-pixel values in the first frame, and a second set of one or more edge subpixel values in the second frame; and estimating the location shift value by comparing the first set of edge values with the second set of edge values.

Another demonstrative embodiment of the invention may include estimating the location shift based on motion vector information corresponding to the first sub-pixel value.

BRIEF DESCRIPTION OF THE DRAWINGS

The invention will be understood and appreciated more fully from the following detailed description of embodiments of the invention, taken in conjunction with the accompanying drawings of which.

Figure 1:
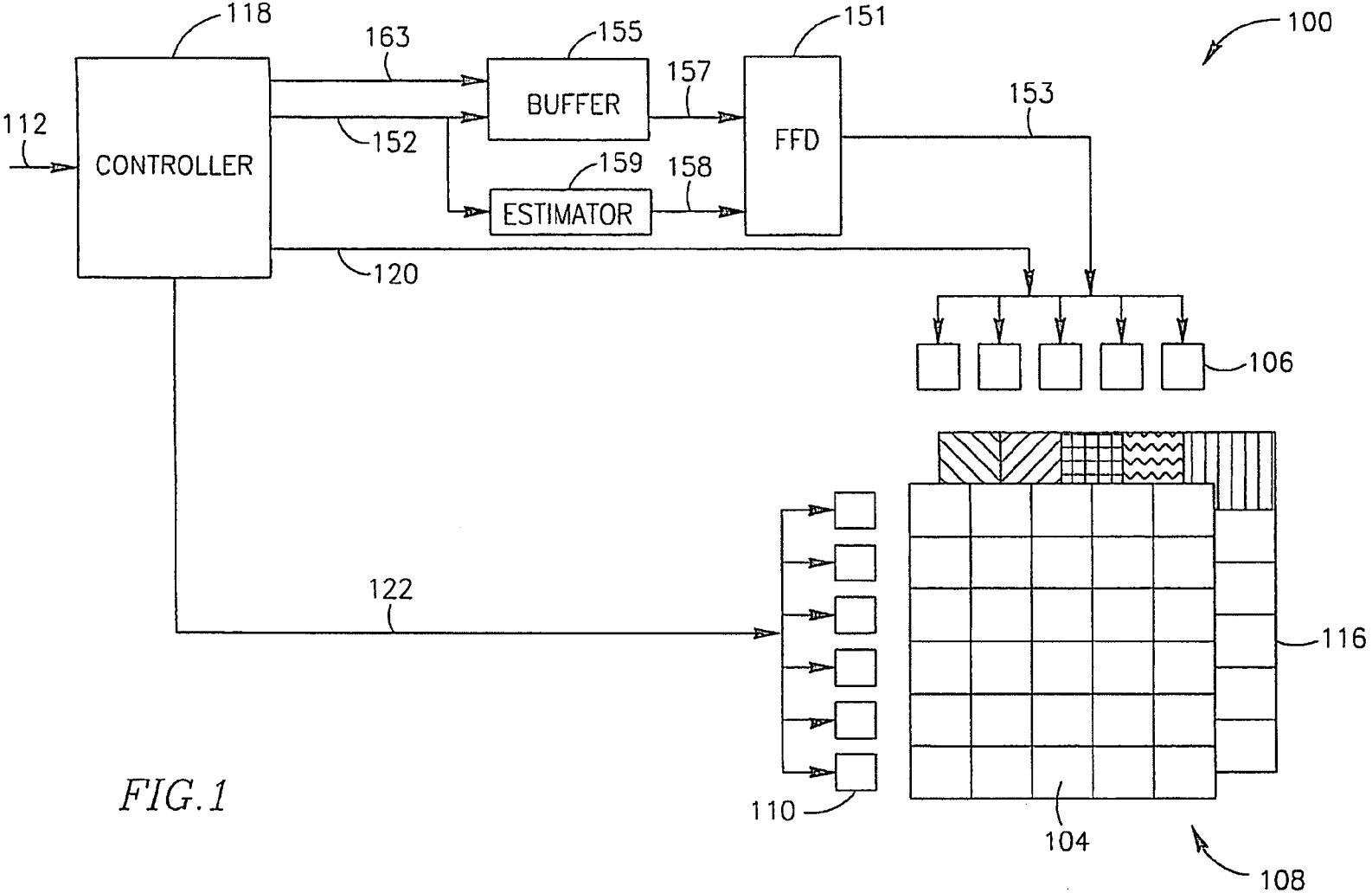
FIG. 1 is a schematic illustration of a Liquid Crystal Display (LCD) system in accordance with some demonstrative embodiments of the invention.

It will be appreciated that for simplicity and clarity of illustration, elements shown in the figures have not necessarily been drawn accurately or to scale. For example, the dimensions of some of the elements may be exaggerated relative to other elements for clarity or several physical components included in one element. Further, where considered appropriate, reference numerals may be repeated among the figures to indicate corresponding or analogous elements. It will be appreciated that these figures present examples of embodiments of the present invention and are not intended to limit the scope of the invention.

DETAILED DESCRIPTION OF DEMONSTRATIVE EMBODIMENTS OF THE INVENTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details presented herein. Furthermore, some features of the invention relying on principles and implementations known in the art may be omitted or simplified to avoid obscuring the present invention.

Unless specifically stated otherwise, as apparent from the following discussions, it is appreciated that throughout the specification discussions utilizing terms such as "processing," "computing," "calculating," "determining," or the like, refer to the action and/or processes of an electronic circuit or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices. In addition, the term "plurality" may be used throughout the specification to describe two or more components, devices, elements, parameters and the like.

Embodiments of the present invention may be implemented by software, by hardware, or by any combination of software and/or hardware as may be suitable for specific applications or in accordance with specific design requirements. Embodiments of the present invention may include units and sub-units, which may be separate of each other or combined together, in whole or in part, and may be implemented using specific, multi-purpose or general processors, or devices as are known in the art. Some embodiments of the present invention may include buffers, registers, storage units and/or memory units, for temporary or long-term storage of data and/or in order to facilitate the operation of a specific embodiment.

Reference is made to FIG. 1, which schematically illustrates a Liquid Crystal Display (LCD) system 100 in accordance with some demonstrative embodiments of the invention.

According to demonstrative embodiments of the invention, system 100 may include an array 108 of liquid crystal (LC) elements (cells) 104, for example, an LC array using Thin Film Transistor (TFT) active-matrix technology, as is known in the art. For example, each of cells 104 may be connected to a horizontal ("row") line (not shown) and a vertical ("column") line (not shown), as is known in the art.

System 100 may also include a first set of electronic circuits 110 ("row drivers") associated with the row lines, and a second set of electronic circuits 106 ("column drivers") associated with the column lines. Drivers 110 and 106 may be implemented for driving the cells of array 108, e.g., by active-matrix addressing, as is known in the art. System 100 may also include a filter array 116 juxtaposed with array 108.

In LCD systems according to some demonstrative embodiments of the invention, each full-color pixel of a displayed image may be reproduced by three or more sub-pixels, each sub-pixel corresponding to a different primary color, e.g., each pixel may be reproduced by driving a corresponding set of three or more sub-pixels. For each of the three or more sub-pixels there may be a corresponding cell in LC array 108, and each LC cell may be associated with a color filter element in color filter array 116 corresponding to one of three or more, respective, primary colors. A back-illumination source (not shown) may provide the illumination needed to produce the color images. The transmittance of each of the sub-pixels may be controlled by controlling a voltage applied, e.g., using column drivers 106, across a corresponding LC cell of array 108. The intensity of white light provided by the back-illumination source may be spatially modulated by elements 104 of LC array 108, thereby selectively controlling the illumination of each sub-pixel according to image data for the sub-pixel. The selectively attenuated light of each sub-pixel passes through the corresponding color filter of color filter array 116, thereby producing desired color sub-pixel combinations. The human vision system spatially integrates the light filtered through the different color sub-pixels to perceive a color image.

According to demonstrative embodiments of the invention, system 100 may also include a controller 118 able to receive a video input signal 112. Signal 112 may include data corresponding to a sequence of video "frames", wherein each "frame" includes a momentary image to be reproduced by system 100. For example, signal 112 may include a High Definition Television (HDTV) video input signal or any other video signal as known in the art.

According to demonstrative embodiments of the invention, controller 118 may be able to produce a primary color sub-pixel data signal 152 including a plurality of sub-pixel "current values" corresponding to a frame to be reproduced ("the current fame"), e.g., as described below. Controller 118 may also provide drivers 106 with control signals 120, and/or drivers 110 with control signals 122, e.g., based on input signal 112, as known in the art.

According to demonstrative embodiments of the invention, system 100 may also include a Response Time Compensation (RTC) module, e.g., a Feed Forward Driving (FFD) module 151, an estimator 159, and a buffer 155. Estimator 159 may be able to receive signal 152 and provide FFD module 151 with an estimated sub-pixel signal 158 including a plurality of estimated sub-pixel "previous values", each corresponding to an estimation of the value of a respective sub-pixel of signal 152 in a previously reproduced frame ("the previous frame"), as described below. Buffer 155 may be controlled by a timing signal 163, e.g., received from controller 118, to provide FFD module 151 with a signal 157 including the sub-pixel "current values" of signal 152 such that FFD module 151 receives the "current value" for a sub-pixel, e.g., via signal 157, and the estimated "previous value" for the same sub-pixel, e.g., via signal 158, substantially concurrently. FFD module 151 may be able to provide drivers 106 with an overdrive sub-pixel data signal 153, e.g., based on a comparison between the sub-pixel value of signals 157 and 158. For example, FFD module 151 may produce sub-pixel signal 153 based on a difference between the sub-pixel "current value" of signal 157 and the estimated sub-pixel "previous value" of signal 158. For example, module 151 may include a FFD Look-Up Table (LUT) able to provide an output signal corresponding to a difference between a current value of a sub-pixel and a previous value of the sub-pixel, as is known in the art.

Aspects of the invention are described herein in the context of an demonstrative embodiment of a controller, e.g., controller 118, an estimator, e.g., estimator 159, a RTC module, e.g., FFD module 151, and/or a buffer, e.g., buffer 155, being separate units of a display system, e.g., system 100. However, it will be appreciated by those skilled in the art that, according to other embodiments of the invention, any other combination of integral or separate units may also be used to provide the desired functionality, for example, the controller may also include the estimator, the RTC module, and/or the buffer.

According to some embodiments of the invention, system 100 may include an n-primary Liquid Crystal Display (LCD) system, wherein n is greater than three. Certain aspects of monitors and display devices with more than three primaries, in accordance with demonstrative embodiments of the invention, are described in International Application PCT/IL02/00452, filed Jun. 11, 2002, entitled "DEVICE, SYSTEM AND METHOD FOR COLOR DISPLAY" and published 19 Dec. 2002 as PCT Publication WO 02/101644 ("Reference 1"), the disclosure of which is incorporated herein by reference in its entirety. According to these demonstrative embodiments, controller 118 may be able to, inter alia, convert three primary data, e.g., of signal 112, into corresponding n-primary data, e.g., as described in reference 1. Additionally, controller 118 may be able to process the n-primary data, for example, according to one or more attributes, e.g., a sub-pixel arrangement, of filter array 116, e.g., as described in reference 1. Accordingly, signal 152, signal 158 and/or signal 157 may include n-primary sub-pixel data.

According to other demonstrative embodiments, system 100 may include a three-primary LCD display system. Accordingly, controller 118 may include, for example, a Timing Controller (TCON) as is known in the art, and signal 152, signal 158 and/or signal 157 may include three-primary sub-pixel data.

According to demonstrative embodiments of the invention, the estimated "previous value" of a certain sub-pixel may correspond to the "current value" of a sub-pixel having a location shifted by an estimated "location-shift" value with respect to the location of the certain sub-pixel. The "location shift" value may refer to a "shift" between the location of a sub-pixel for corresponding to a certain image element in the current frame and the location of a sub-pixel corresponding to the certain image element in a previous frame, as described in detail below.

According to some demonstrative embodiments of the invention, the "location-shift" value may be estimated based on a comparison between the location of one or more image elements in the current frame and in the previous frame, as described below.

Figure 2:
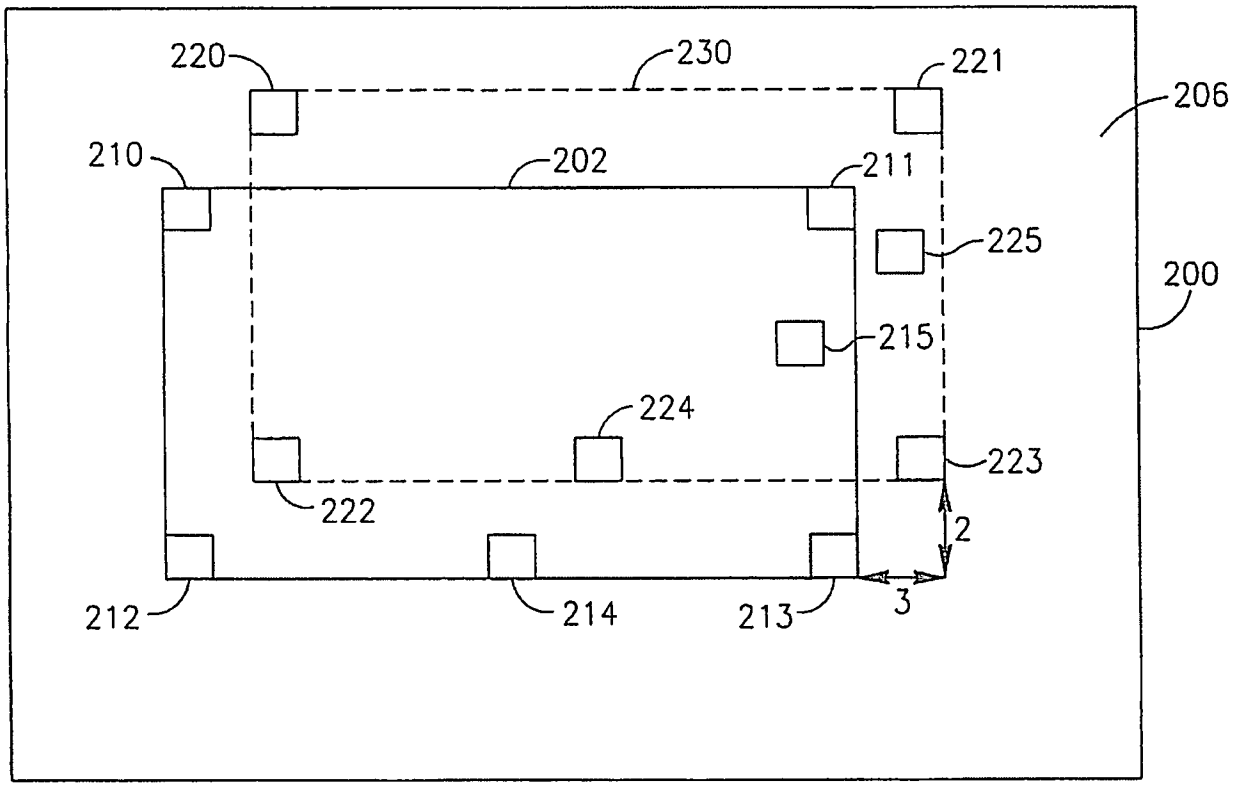
FIG. 2 is a schematic illustration of first and second sub-pixel sets of a segment of a display corresponding to an image element in a previous frame, and in a current frame, respectively, in accordance with some demonstrative embodiments of the invention.

Reference is made to FIG. 2, which schematically illustrates a first sub-pixel set 202 of a segment 200 of display 100 corresponding to a certain image element in the previous frame, and a second sub-pixel set 230 corresponding to the certain image element in the current frame, in accordance with demonstrative embodiments of the invention.

According to demonstrative embodiments of the invention, segment 200 may include a plurality of sub-pixels of a predetermined number of lines and/or rows of a LCD, e.g., display 100 (FIG. 1). For example, segment 200 may include between 1 and 8, e.g., 4 lines, and/or one or more rows, e.g., corresponding to a whole line of the display.

According to some embodiments of the invention, the image element may be identified by a plurality of "edge" sub-pixels, e.g., sub-pixels corresponding to at least part of the contour of the image element. For example, in the previous frame the image element may be identified by a plurality of "edge" sub-pixels of set 202, e.g., including a sub-pixel 210, a sub-pixel 211, a sub-pixel 212 and/or a sub-pixel 213 corresponding to a top-left corner, a top-right corner, a bottom-left corner and a bottom-right corner, respectively, of the image element in the previous frame. Set 202 may additionally or alternatively include any other sub-pixel, e.g., a sub-pixel 214, corresponding to the contour of the image element in the previous frame. In the current frame, the image element may be identified by a plurality of "edge" sub-pixels, e.g., including a sub-pixel 220, a sub-pixel 221, a sub-pixel 222 and/or a sub-pixel 223 corresponding to a top-left corner, a top-right corner, a bottom-left corner and a bottom-right corner, respectively, of the image element in the current frame. Set 230 may additionally or alternatively include any other sub-pixel, e.g., a sub-pixel 224, corresponding to the contour of the image element in the previous frame.

According to demonstrative embodiments of the invention, an "edge" sub-pixel may be defined as a sub-pixel having an attribute value, e.g., a luminance and/or a primary color value, which is different than an attribute value of a neighboring sub-pixel by more than a predetermined threshold value, e.g., as described below.

Figure 3:
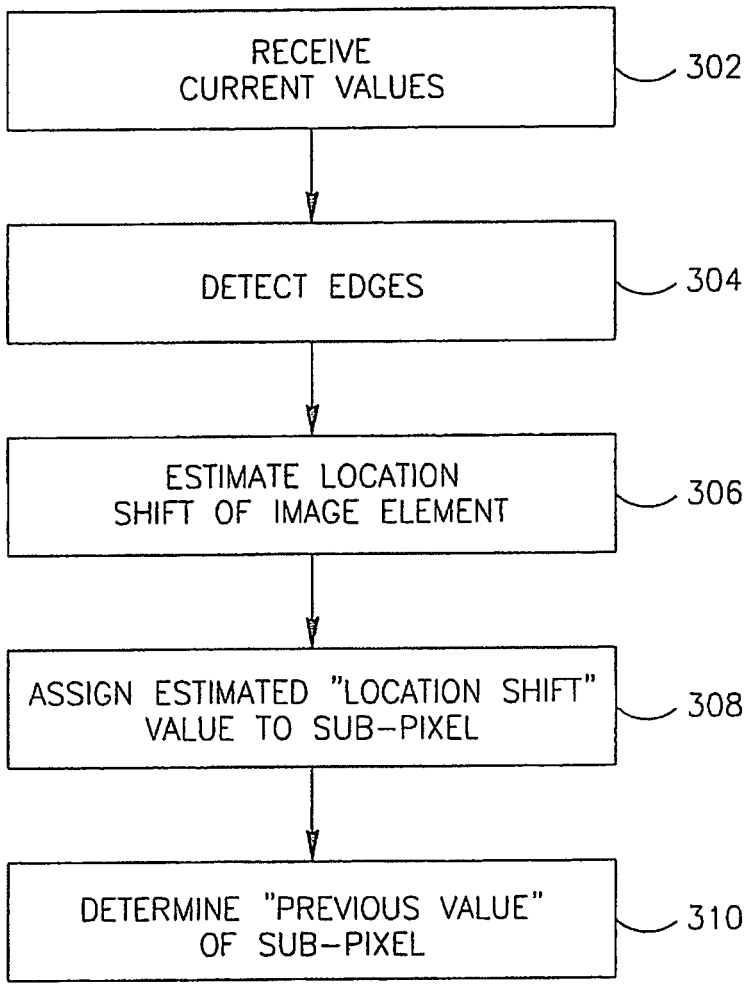
FIG. 3 is a schematic illustration of a method for estimating a previous value of a sub-pixel according to some demonstrative embodiments of the invention.

Reference is also made to FIG. 3, which schematically illustrates a method for estimating the previous value of a certain sub-pixel according to demonstrative embodiments of the invention.

As indicated at block 302, the method may include receiving the current values of sub-pixels of a predetermined segment of the display, e.g., segment 200.

As indicated at block 304, the method may also include detecting, e.g., as described below, one or more "edge" values of the received current values to provide "current edge" data, e.g., including the location and/or value of one or more of the "edge" sub-pixels in the current frame.

As indicated at block 306, the method may also include estimating a location shift of one or more image elements in the predetermined segment, e.g., segment 200, for example, by comparing the "current edge" data with corresponding "previous edge" data, e.g., including the location and/or value of "edge" sub-pixels in the previous frame. For example, the current "edge" sub-pixels may include sub-pixels 220, 221, 222, 223, and/or 224; and the previous "edge" sub-pixels may include sub-pixels 210, 211, 212, 213, and/or 214, e.g., each being shifted three sub-pixels to the left and two sub-pixels down compared to sub-pixels 220, 221, 222, 223, and/or 224, respectively. Accordingly the estimated location shift of the image element corresponding to set 230 may be three sub-pixels to the left and two sub-pixels down.

According to some demonstrative embodiments of the invention, estimating the location shift of the image element may include identifying the size, shape, orientation and/or location of the image element in the previous frame and/or the current frame, for example, based on a comparison between the "current edge" data and the "previous edge" data. Comparing the "current edge" data and the "previous edge" data may include, for example, comparing the color and/or luminance values of the current "edge" sub-pixels, and/or values of one or more sub-pixels adjacent to the current "edge" sub-pixels, with the color and/or luminance values of the previous "edge" sub-pixels, and/or values of one or more sub-pixels adjacent to the previous "edge" sub-pixels. Additionally or alternatively, the distance between two or more current "edge" sub-pixels may be compared to the distance between two or more previous "edge" sub-pixels in order to identify the size, shape, orientation and/or location of the one or more image elements.

As indicated at block 308, an estimated "location shift" value representing the location shift of an image element may be assigned to one or more sub-pixels of the set of sub-pixels corresponding to the image element. For example, a sub-pixel of set 230, e.g., a sub-pixel 225, located between sub-pixels 220, 221, 222 and 223 may be assigned a "location-shift" value of three sub-pixels to the left and two sub-pixels down.

As indicated at block 310, the method may also include determining the previous value of a certain sub-pixel of the predetermined segment based on the "location shift" value of the certain sub-pixel. For example, the "previous value" of the certain sub-pixel may be determined to be the current value of a sub-pixel having a location shifted by the "location-shift value" with respect to the certain sub-pixel. For example, the "previous value" of sub-pixel 225 may be determined to be equal to the current value of another sub-pixel, e.g., sub-pixel 215, having a location shifted by three pixels to the left and two pixels down with respect to sub-pixel 225.

Figure 4:
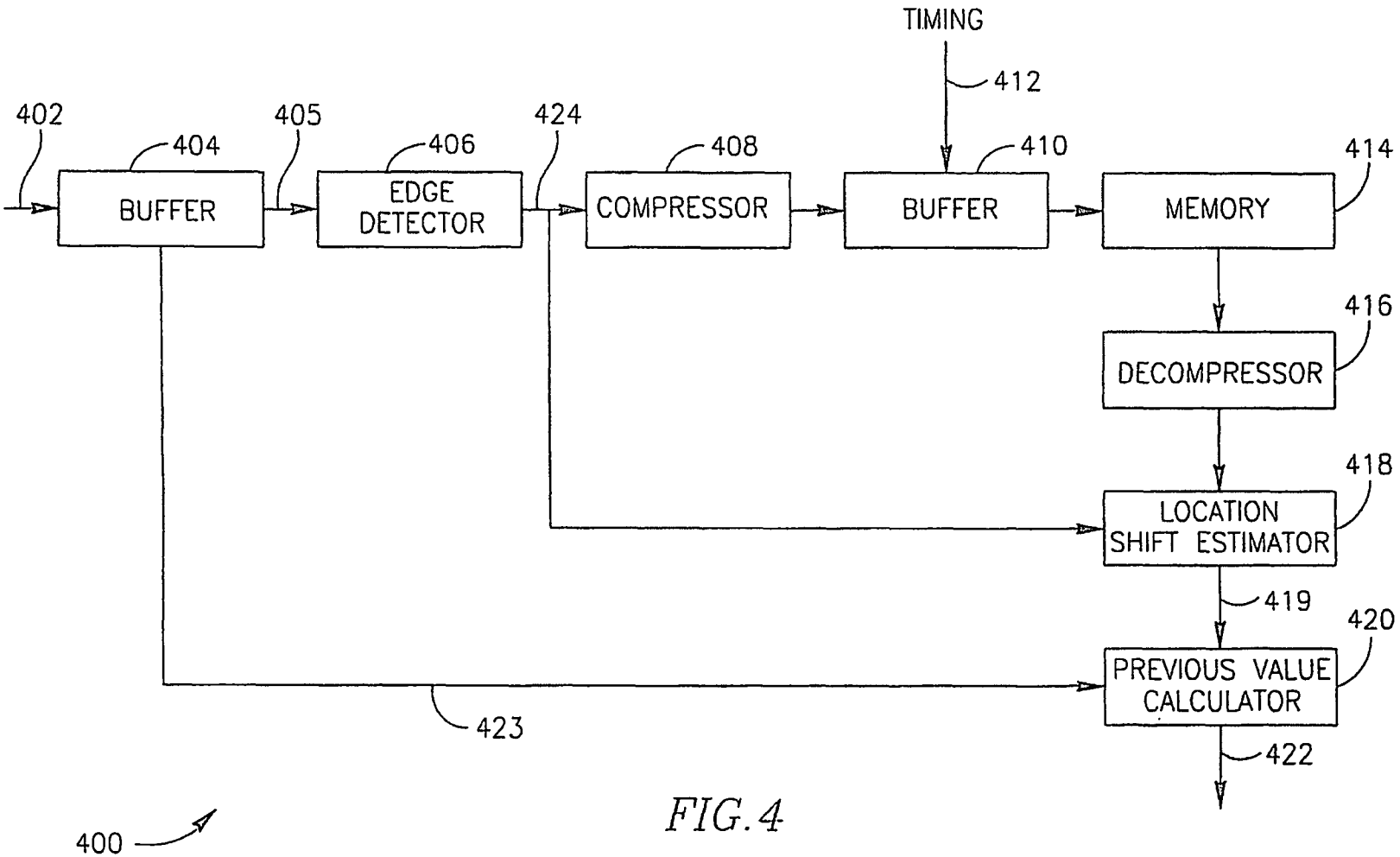
FIG. 4 is a schematic illustration of an estimator according to some demonstrative embodiments of the invention.

Reference is also made to FIG. 4, which schematically illustrates an estimator 400 according to demonstrative embodiments of the invention.

According to demonstrative embodiments of the invention, estimator 400 may be able to implement at least part of the estimation method described above with reference to FIG. 3.

According to demonstrative embodiments of the invention, estimator 400 may include a buffer 404 to receive, e.g., from controller 118 (FIG. 1), a primary color sub-pixel data signal 402 including a plurality of current sub-pixel values corresponding to a predetermined segment of the display, e.g., segment 200 (FIG. 2).

According to demonstrative embodiments of the invention, estimator 400 may also include an edge detector 406 able to detect one or more "edge" values of the current values of the sub-pixels, e.g., as received from buffer 404 via a signal 405. An output signal 424 of edge detector 406 may include, for example, a sequence of values identifying whether or not a corresponding sub-pixel is an "edge" sub-pixel. For example, signal 424 may include a sequence of values, e.g., including the values "−1", "0" and/or "1", wherein the value "0" may correspond to a "non-edge" sub-pixel, the value "1" may correspond to an "edge" sub-pixel succeeding a "non-edge" pixel, and the value "−1" may correspond to an "edge" sub-pixel preceding a "non-edge" sub-pixel.

Figure 5:
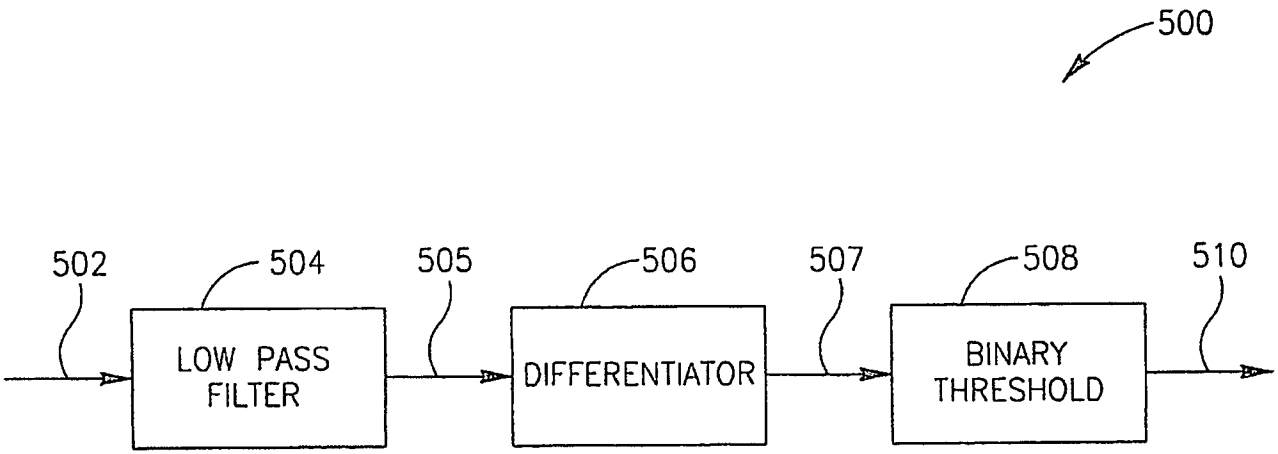
FIG. 5 is a schematic illustration of an edge detector according to some demonstrative embodiments of the invention.

Reference is now made to FIG. 5, which schematically illustrates an edge detector according to some demonstrative embodiments of the invention.

According to demonstrative embodiments of the invention, edge detector 500 may include a low pass filter 504 adapted to filter high frequency spatial noise from a primary color sub-pixel data signal 502 including the "current value" of a sequence of sub-pixels.

Edge detector 500 may also include a differentiator 506 adapted to provide a signal 507 including a sequence of differential values corresponding to the output of filter 504. Edge detector 500 may also include a threshold module 508 to provide an output signal 510 including a sequence of values, e.g., the values "−1", "0" and "1", corresponding to the differential values of signal 507. For example, the value "1" may correspond to a differential value of signal 507 which is equal to or larger than a first predetermined threshold value, the value "−1" may correspond to a differential value which is equal to or smaller than a second predetermined threshold value, and the value "0" may correspond to a differential value larger than the second threshold value but smaller than the first threshold value.

According to some demonstrative embodiments, the first threshold value may be equal, for example, to the absolute value of the second threshold value. The first threshold value and/or the second threshold value may be predetermined based on any desired criteria. For example, the first and/or second threshold values may be experimentally predetermined, e.g., by providing the display with a set of data values and determining the first and/or second threshold values suitable for identifying the edge values. Additionally or alternatively, the first and/or second threshold values may be adaptively modified, e.g., based on previously displayed data.

According to demonstrative embodiments of the invention, low pass filter 504, differentiator 506 and/or threshold module 508 may be implemented using any suitable hardware and/or software, e.g., as known in the art.

Referring back to FIG. 4, estimator 400 may also include a "location shift" estimation module 418 to produce a signal 419 including a sequence of estimated "location shift" values based on the sequence of "edge" values of signal 424 and a sequence of corresponding "edge" values of the previous frame, e.g., received from a memory 414. Module 418 may implement one or more procedures of the method described above with reference to FIG. 3 to estimate the "location shift" values.

According to some demonstrative embodiments of the invention, the "edge" values of the previous frame may be stored in memory 414 in a compressed format. According to these embodiments, estimator 400 may also include a decompressor 416, e.g., as is known in the art, to receive the "edge" values from memory 414 in the compressed format and to provide module 418 with the "edge" values in a decompressed format. Estimator 400 may also include a compressor 408, e.g., as is known in the art, to receive the "edge" values from edge detector 406 and provide them to memory 414 in the compressed format. Estimator 400 may also include a buffer 410 which may provide memory 414 with the output of compressor 408 after the corresponding "edge" values of the previous frame are provided to module 418. For example, buffer 410 may be controlled by a timing signal 412, e.g., received from controller 118 (FIG. 1).

According to some demonstrative embodiments of the invention, any other information related to the detected "edge" values may be stored in memory 414. For example, in some embodiments of the invention estimator 400 may also detect a movement of an "edge" sub-pixel, e.g., between the previous frame and the current frame. Estimator 400 may store in memory 414 information relating to the movement of an "edge" sub-pixel, e.g., information indicating a change in luminance, and/or a change in color relating to the edge sub-pixel.

According to demonstrative embodiments of the invention, estimator 400 may also include a previous value calculator 420 adapted to estimate the "previous value" of one or more of the sub-pixels of the predetermined segment, based on one or more of the "location shift" values of signal 419 and a "current value" of the sub-pixels, e.g., provided by buffer 404 via a signal 423. For example, the "previous value" of a certain sub-pixel may be determined to be the current value of a sub-pixel, e.g., another sub-pixel, having a location shifted by the "location-shift value" with respect to the certain sub-pixel, as described above.

Although some embodiments of the invention are described with reference to an estimator implementing the estimation method described above with reference to FIG. 3, it will be appreciated by those skilled in the art that other embodiments of the invention, may include an estimator implementing any other suitable estimation method. For example, the estimator may estimate the "previous value" of a sub-pixel based on "motion vector" information, e.g., received from an MPEG decoder, as is known in the art. Such "motion vector" information may be used by the estimator to estimate the "location shift" value corresponding to a sub-pixel. Based on the "location shift" value the estimator may estimate the "previous value" of the sub-pixel, e.g., as described above. For example, system 100 (FIG. 1) may include any suitable interface to receive the motion vector information, e.g., from the MPEG decoder, and to provide the motion vector information to estimator 159 (FIG. 1).

It will be appreciated by those skilled in the art, that a LCD system according to demonstrative embodiments of the invention, e.g., display system 100 (FIG. 1), may include a memory, e.g., memory 414, having a relatively small size. For example, an LCD display including 1080 lines, each including 1920 pixels, may include a memory having a size of less than 16 Kilobytes for storing the "edge" values, assuming each line includes an average of 10 "edge" values and 11 bits are used to define a location of each sub-pixel corresponding to the "edge" value. This memory size is significantly smaller than the memory size generally used by conventional LCD systems, e.g., between 600 Kilobytes and 6 Megabytes.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A liquid crystal display device for reproducing a sequence of at least first and second color image frames by controllably activating an array of liquid crystal elements, the array including at least a first liquid crystal element to reproduce first and second sub-pixel values in said first and second frames, respectively, said device comprising:

a sub-pixel value estimator to estimate said first sub-pixel value based on a third sub-pixel value to be reproduced in said second frame by a second liquid crystal element of said array which is shifted in relation to said first liquid crystal element by a location shift value associated with said first liquid crystal element; and a response-time-compensation module to generate an overdrive signal for activating said first liquid crystal element based on a combination of said first and second sub-pixel values, wherein the sub-pixel value estimator further comprises:

an edge detector configured to detect a first set of one or more edge sub-pixel values in said first frame, and a second set of one or more edge sub-pixel values in said second frame;

a location shift estimator configured to estimate said location shift value by comparing said first set of one or more edge sub-pixel values with said second set of one or more edge sub-pixel values; and a memory configured to maintain one or more values corresponding to said first set of one or more edge sub-pixel values, and wherein said edge detector comprises:

a differentiator to receive first and second sequences of sub-pixel values corresponding to said first and second frames, respectively, and to generate first and second sequences of differentiated values corresponding to differences between consecutive sub-pixel values of said first and second sequences, respectively; and a threshold module to generate said first set of edge values by comparing said first sequence of differentiated values to one or more predetermined threshold values, and to generate said second set of edge values by comparing said second sequence of differentiated values to said one or more threshold values, and wherein the memory only stores the edge sub-pixel values after the edge sub-pixel values are written to the memory.

2. The device of claim 1, wherein said location shift value represents a shift of a location of an image element reproduced by said first liquid crystal element in said first frame in relation to a location of said image element in said second frame.

3. The device of claim 1, wherein the one or more values corresponding to said first set of edge values comprise a compressed set of values representing said first set of edge values, and wherein said device comprises:

a compressor to generate said compressed set of values;

a de-compressor to decompress said compressed set of values.

4. The device of claim 1 comprising a location shift estimator to estimate said location shift based on motion vector information corresponding to said first sub-pixel value.

5. The device of claim 1, wherein said second sub-pixel value is said first sub-pixel value, and wherein said second sub-pixel value is said third sub-pixel value.

6. A method of reproducing a sequence of at least first and second color image frames by controllably activating an array of liquid crystal elements, the array including at least a first liquid crystal element to reproduce first and second sub-pixel values in said first and second frames, respectively, said method comprising:

estimating said first sub-pixel value based on a third sub-pixel value to be reproduced in said second frame by a second liquid crystal element of said array which is shifted in relation to said first liquid crystal element by a location shift value associated with said first liquid crystal element; and generating an overdrive signal for activating said first liquid crystal element based on a combination of said first and second sub-pixel values, detecting a first set of one or more edge sub-pixel values in said first frame, and a second set of one or more edge sub-pixel values in said second frame;

estimating said location shift value by comparing said first set of one or more edge sub-pixel values with said second set of one or more edge sub-pixel values; and in a memory, storing only one or more values corresponding to said first set of one or more edge sub-pixel values, wherein said detecting further comprises:

receiving first and second sequences of sub-pixel values corresponding to said first and second frames, respectively;

generating first and second sequences of differentiated values corresponding to differences between consecutive sub-pixel values of said first and second sequences, respectively;

determining said first set of edge values by comparing said first sequence of differentiated values to one or more predetermined threshold values; and determining said second set of edge values by comparing said second sequence of differentiated values to said one or more threshold values.

7. The method of claim 6, wherein said location shift value represents a shift of a location of an image element reproduced by said first liquid crystal element in said first frame in relation to a location of said image element in said second frame.

8. The method of claim 6 comprising:

generating a compressed set of values representing said first set of edge values;

maintaining said compressed set of values; and decompressing said compressed set of values.

9. The method of claim 6 comprising estimating said location shift based on motion vector information corresponding to said first sub-pixel value.

10. The method of claim 6, wherein said second sub-pixel value is said first sub-pixel value, and wherein said second sub-pixel value is said third sub-pixel value.

* * * * *